US007056873B1

(12) United States Patent
Sidgwick et al.

(10) Patent No.: US 7,056,873 B1
(45) Date of Patent: Jun. 6, 2006

(54) LAVATORY CLEANSING BLOCK

(75) Inventors: Ian Sidgwick, Norwich (GB); Steve Balls, Thetford (GB); Russell Norman, Diss (GB); Brian D. Wilson, Diss (GB)

(73) Assignee: Jeyes Group Limited, Thetford (GB)

( * ) Notice: Subject to any disclaimer, the term of this patent is extended or adjusted under 35 U.S.C. 154(b) by 0 days.

(21) Appl. No.: 09/807,726

(22) PCT Filed: Oct. 18, 1999

(86) PCT No.: PCT/GB99/03453

§ 371 (c)(1),
(2), (4) Date: May 21, 2001

(87) PCT Pub. No.: WO00/23558

PCT Pub. Date: Oct. 19, 1999

(30) Foreign Application Priority Data

Oct. 19, 1998 (GB) ..... 9822818.2

(51) Int. Cl.
*C11D 13/18* (2006.01)
*C11D 3/395* (2006.01)
*C11D 3/50* (2006.01)

(52) U.S. Cl. ..... 510/191; 510/192; 510/101; 510/141; 510/146; 510/298; 510/440; 510/446; 510/451; 510/367

(58) Field of Classification Search ..... 510/191, 510/192, 101, 141, 146, 298, 440, 446, 451, 510/367

See application file for complete search history.

(56) References Cited

U.S. PATENT DOCUMENTS

| | | | | | |
|---|---|---|---|---|---|
| 4,460,490 | A | * | 7/1984 | Barford et al. | 252/92 |
| 4,557,926 | A | | 12/1985 | Nelson et al. | 424/19 |
| 4,578,207 | A | * | 3/1986 | Holdt et al. | 252/134 |
| 4,683,072 | A | * | 7/1987 | Holdt et al. | 252/102 |
| 5,756,440 | A | | 5/1998 | Watanabe et al. | 510/191 |
| 5,759,974 | A | | 6/1998 | Menke et al. | 510/191 |

FOREIGN PATENT DOCUMENTS

| | | | |
|---|---|---|---|
| DE | 44 38 677 | A1 | 5/1996 |
| EP | 0 055 100 | A1 | 6/1982 |
| EP | 0 101 402 | A1 | 2/1984 |
| EP | 0 171 494 | A1 | 2/1986 |
| EP | 0 206 725 | A2 | 12/1986 |
| GB | 2 089 830 | A | 6/1982 |
| GB | 2 333 778 | A | 8/1999 |

* cited by examiner

*Primary Examiner*—Charles Boyer
(74) *Attorney, Agent, or Firm*—Blank Rome LLP

(57) ABSTRACT

A lavatory cleansing block has two parts co-extruded together, the first part containing a chlorine releasing bleach and the second part containing component such as a perfume or colorant which need not be bleach resistant. Migration of components is avoided if there is no common hydrophobe in the two parts. The perceived performance of the perfume is enhanced by its juxtaposition with the bleach.

17 Claims, 1 Drawing Sheet

LAVATORY CLEANSING BLOCK

Figure 1:
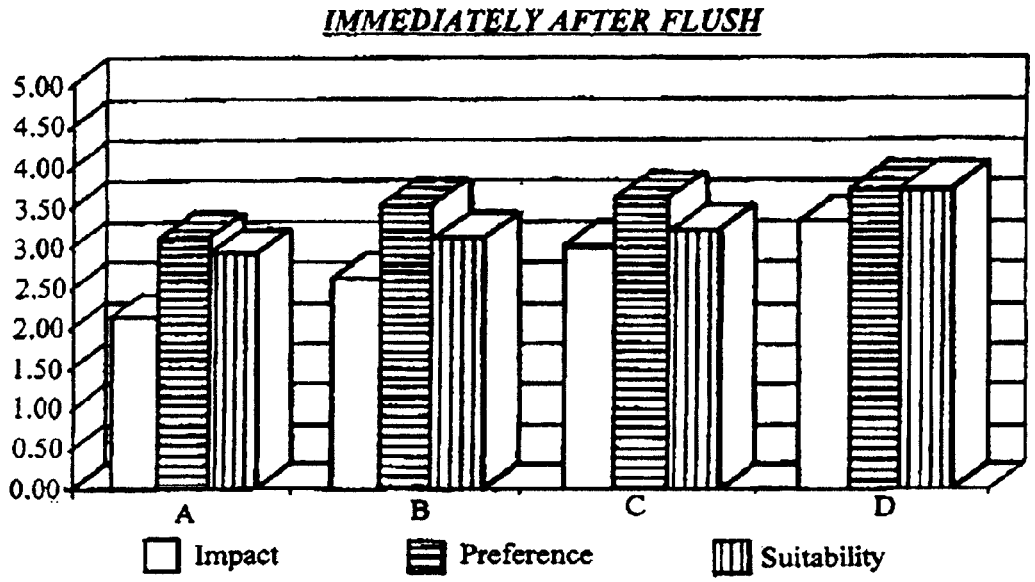

The present relates to a lavatory cleansing block, and in particular to a bleach containing block.

Typically, lavatory cleansing blocks are immersed in the water cistern of a lavatory (a cistern block), or held in a cage under the rim of the lavatory bowl (a rim block), or on the top of the cistern, as in Japan for example (an on-tank block). The block dissolves slowly, releasing cleansing ingredients into the lavatory bowl.

Generally such blocks may contain, as major ingredients:

(i) a solubility retardant or control agent to control the rate of dissolution of the ingredients (ii) a surface active component to provide a cleaning effect, and also to provide a foam as an indicator to the user (iii) a bleach component (iv) a colouring agent (v) a perfume (vi) a germicide (vii) fillers and processing aids.

In formulating a working block it is necessary to take into account difficulties of block manufacture, stability of the block on storage, the performance of the block in use, and the cost of the block.

Blocks are commonly made by extrusion. This subjects the ingredients to elevated temperatures and pressures and the selection of ingredients, particularly when using a bleach component, is important to avoid hazards during the extrusion process, and to produce an extrusion with sufficient integrity for subsequent cutting of the extruded rod (to form a block) and wrapping etc.

On storage, which may be in relatively hot and humid conditions in some climates, it is necessary to account for the stability of the block. Again, bleach containing blocks may lose their effectiveness (e.g. components decompose, the bleach attacks the perfume, available chlorine in chlorine based bleaching agents is lost), and also they may discolour. Whilst this is particularly a problem for blocks containing both a colourant and a bleach, even white blocks may discolour over time.

The performance of the block is governed both by the actual, scientifically measurable performance, and also by the perceived performance of the user. Thus, with surface active agent containing blocks (foaming blocks) it is desirable to ensure that a reasonable amount of stable foam (ideally lasting a minute or more) is produced in the flush water late in the block life. A block containing a colourant or a perfume should continue to produce a reasonable depth of colour, and an attractive colour and/or smell late into the block life. The preferred life for a block is 28 days for normal domestic use in hard or soft water, but a block life up to five months is desired for some applications.

There has been extensive work on the development of toilet blocks to provide blocks meeting the various requirements set out above.

There are particular difficulties when formulating bleach containing blocks because of the instability of bleaches during manufacture of the block and also on storage, and because the bleach will degrade other components, particularly colorants and perfumes.

One early approach to the manufacture of rim blocks was to have a rim cage which has two chambers for containing incompatible components in the different chambers.

There have been proposals to manufacture a two-part block. EP-A-55100 discloses a cistern block having a surface active component in the main body of the block, and a tablet containing a bleaching agent is embedded in one wall of the block body. EP-A-55100 proposes that the bleaching agent tablet should be coated to isolate it from the surface active component in order to prevent discolouration and other effects on the block performance.

EP-A-101402 also suggests a two part cistern block to separate incompatible substances. However there have been reports that it is difficult to manufacture the blocks exemplified in EP-A-101402.

With a cistern block, the components of the block pass into solution in the cistern between flushes, and so there is mixing of the "incompatible components" for a period of time before the cistern is flushed. This can affect the performance of the ingredients, particularly colourant when used in combination with a bleach, and so it is still necessary to account for the interaction of the ingredients over a period of time.

Thus, it has generally been preferred to manufacture a single, integrally formed block and it has been accepted that this places constraints on the choice of block constituents, in particular they must be resistant to the bleach.

We have now found that it is possible to provide a viable two part lavatory cleansing block and that proper choice of constituents can lead to improvements in performance.

One problem with two-part or co-extruded blocks is the migration of the bleach incompatible substances into the bleach containing part. EP A-55100 solved this problem by placing a barrier between the parts.

A first aspect of the invention provides a lavatory cleansing block which has been formed by extruding two compositions, only one of the compositions containing a bleach, and the other composition containing a component which is incompatible with the bleach, characterised in that the compositions do not have a common hydrophobe component.

EP-A-101402 uses pine oil, a hydrophobic perfume, in both parts of the block. We have found that by ensuring that there is not a common hydrophobe in the block parts, the migration of the bleach sensitive component can be substantially avoided.

Another aspect of the invention provides a lavatory cleansing block having a first part which contains a bleach agent and a second part which contains a perfume, for the purpose of enhancing the performance of the perfume in the second part.

We have found that by separating the bleaching agent and the perfume in a rim block we obtain enhanced performance of the perfume component, over and above any improved performance which might be expected from separating the components. The perfume in the second part of the block need not be stable to the bleach. A bleach stable perfume may still be incorporated in the first part, with the bleach, but would be different to the perfume in the second part to avoid the use of a common hydrophobe.

Yet another aspect of the invention provides a lavatory cleansing block comprising a first block portion formed of a composition including a bleach, and a second portion including a bleach activator.

A bleach activator has long been a desirable component for a lavatory cleansing block composition, but it has not hitherto been possible to incorporate one in a toilet block.

Preferably the bleach is a halogen release agent. Preferably the halogen release agent is a chlorine release agent, more preferably a chlorinated cyanuric acid derivative such as sodium dichloroisocyanurate. Preferably the bleaching agent is present in an amount of from 2 to 75% by weight of the complete block, preferably 5 to 60% and more preferably 10 to 40% by weight. The bleaching agent is contained in one part of the block. It is desirable to have block parts of about equal size and hence about equal weight. An amount of about 10 to 25% and preferably about 15% of the total block weight is particularly preferred.

The surface active agent may be distributed between the two block parts. The same surface active agent may be used in each part, or different agents may be used. Typical surface active agents include anionics such as alkali metal paraffin sulphonates, alkali metal alkyl sulphates and alkyl aryl sulphonates, particularly alkyl benzene sulphonates. Preferably the surface active agent is present in an amount of from about 5 to about 75% by weight of the finished block, preferably about 20 to about 60%, and more preferably about 40 to about 50%.

The perfume is preferably present in an amount of from about 0.5 to about 15% by weight of the final block, preferably about from 2 to about 10%, and more preferably from about 3 to about 7% by weight. As noted above, a perfume is preferably incorporated in a different part of the block to the bleaching agent to enhance the perfume performance.

Preferably the block parts are extruded, and more preferably are co-extruded side-by-side.

Very preferably a colourant is provided in at least one of the block parts. Preferably the colourant will be provided in the block part containing the perfume, since many colourants are affected, in time, by bleaching agents. The colourant may provide a colour to the flush water if a sufficient amount is dispersed during a flushing operation, but also the colourant provides an attractive appearance to the finished block.

When present, the bleach activator is preferably in an amount of from 0.05 to 5% by weight, preferably 0.25 to 3% by weight of the complete block, more preferably 0.3 to about 2% and preferably about 0.5% by weight. In the alternative it may be present in an amount about equal to the molar equivalent of the bleach. The preferred bleach activator is sodium bromide. Other suitable bleach activators are mentioned in GB 1345 119 for example.

Other components of the block may include processing aids, fillers, water softening agents, and solubility control agents as known in the art. It will be appreciated that each part of the block will, because of the different basic components, impose different constraints on the required processing aids etc.

The invention will be further described by way of example. The following compositions are prepared and pairs of the compositions are extruded to test the performance of the formed block. The compositions are co-extruded, or extruded as complementary shapes which are brought together. The amounts of each component are the weight per cent in the composition, not the finished block.

1. COLOUR COMPOSITION

| Trade Name | Chemical Name | % w/w |
|---|---|---|
| | Sodium alkylarylsulphonate 80% | 48.0 |
| $MgSO_4.7H_2O$ | n/a | 10.0 |
| Sodium Sulphate | n/a | 25.0 |
| Sodium Stearate | n/a | 1.0 |
| Pine Oil | n/a | 8.0 |
| Acid Blue 9 | CI Acid Blue 9 Trimethane Dye | 8.0 |

-continued

2. PERFUME COMPOSITION

| Trade Name | Chemical Name | % w/w |
|---|---|---|
| | Sodium Alkylarylsulphonate 80% | 40.0 |
| $MgSO_4.3H_2O$ | n/a | 5.0 |
| Sodium Sulphate | n/a | 47.34 |
| PEG 6000 distearate | n/a | 0.3 |
| Perfume LQ52707 | n/a | 7.30 |
| Paliogen Yellow L1560 | Anthrapyrimidine pigment | 0.06 |

3. BLEACH COMPOSITION

| Trade Name | Chemical Name | % w/w |
|---|---|---|
| | Sodium alkylarysulphonate (90%) | 43.7 |
| | Sodium alkylarysulphonate (80%) + $MgSO_4.7H_2O$ | 18.0 |
| SDIC | Sodium dichloroisocyanurate dihydrate | 30.0 |
| | Triethylene glycol caprate caprylate | 6.0 |
| Mineral Oil | n/a | 2.0 |
| Titanium dioxide | n/a | 0.3 |

4. PERFUME COMPOSITIONS

| Trade Name | Chemical Name | % w/w A | % w/w B | % w/w C |
|---|---|---|---|---|
| | Sodium alkylarylsulphonate 80% | 50.0 | 50.0 | 50.0 |
| | Sodium alkane sulphonate | 9.80 | 9.80 | 9.80 |
| $MgSO_4.3H_2O$ | n/a | 5.0 | 5.0 | 5.0 |
| Sodium sulphate | n.a | 28.115 | 28.14 | 28.18 |
| Perfume F544.744 | n/a | 7.0 | 0 | 0 |
| Perfume LU63651 | n/a | 0 | 7.0 | 0 |
| Perfume LQ52707 | n/a | 0 | 0 | 7.0 |
| Sicopal Green K9710 | Pigment Green 50 | 0.03 | 0 | 0 |
| Paliogen Yellow L1560 | Anthrapyrimidine pigment | 0.005 | 0.02 | 0.02 |
| Titanium Dioxide | n/a | 0.01 | 0 | 0 |
| Bitrex (25% w/v) | n/a | 0.04 | 0.04 | 0 |

5. COLOUR COMPOSITION

| Trade Name | Chemical Name | % w/w |
|---|---|---|
| | Sodium Alkylarylsulphonate 80% | 45.0 |
| $MgSO_4.3H_2O$ | n/a | 5.0 |
| Sodium Sulphate | n/a | 37.90 |
| Pine Oil | n/a | 7.0 |
| Acid Blue | CI Acid Blue 9 Trimethane Dye | 5.1 |

6. BLEACH COMPOSITION

| Trade Name | Chemical Name | % w/w |
|---|---|---|
| | Sodium alkylarylsulphonate (90%) | 40.3 |
| | Sodium alkylarylsulphonate (80%) | 19.50 |
| SDIC | Sodium dichloroisocyanurate dihydrate | 30.0 |
| | Triethylene glycol caprate caprylate | 7.0 |
| Mineral Oil | n/a | 3.0 |
| Titanium dioxide | n/a | 0.20 |

7. COLOUR COMPOSITION

| Trade Name | Chemical Name | % w/w |
|---|---|---|
| | Sodium alkylarysulphonate 90% | 40.0 |
| | Sodium alkylarysulphonate 80% + $MgSO_47H_2O$ | 19.5 |
| Sodium Sulphate | n/a | 24.5 |
| Mineral Oil | n/a | 1.0 |

-continued

| | | |
|---|---|---|
| Acid Blue | CI Acid Blue 9 Trimethane Dye | 6.0 |
| | Triethylene glycol caprate caprylate | 9.0 |

8. PERFUME AND COLOUR COMPOSITION

| Trade Name | Chemical Name | % w/w |
|---|---|---|
| | Sodium alkylarysulphonate 80% | 40.0 |
| $MgSO_4.3H_2O$ | n/a | 5.0 |
| Sodium Sulphate | n/a | 46.34 |
| Sodium Bromide | n/a | 1.0 |
| PEG 6000 distearate | n/a | 0.3 |
| Perfume LQ52707 | n/a | 7.30 |
| Paliogen Yellow L1560 | Anthrapyrimidine pigment | 0.06 |

Cistern Block Formulations

Pairs of the above compositions were co-extruded to form a circular block of diameter about 45 to 50 mm and depth about 21 to 23 mm, each composition being extruded in a D shape to form about half the finished block weight of about 50 to 53 gm.

The combinations 1 with 3 and 2 with 3 both provided stable block formulations having good performance.

The combination 6 with 7 had poor performance on storage due to the use of a common hydrophobe, the caprylate, in the two block halves leading to migration of the colourant Acid blue 9, and hence discolouration.

The combination 3 with 8 which uses a bleach activator as well as perfume and colourant in component 8, gave good performance. The bleach activator The combination 3 with 8 which uses a bleach activator as well as perfume and colourant in component 8, gave good performance. The bleach activator could not be used within the block composition 3 which incorporates a bleach, SDIC.

Rim Blocks

Finished blocks of dimension about 26 mm×27 mm×57 mm are formed by co-extruding pairs of compositions to give a finished block weight of about 40 gm (20 gm of each composition). The blocks are held in a rim cage with the two block portions side by side so that they are both exposed to substantially the same water flow.

The combinations 4A, 4B or 4C with 6, and 5 with 6 gave good performance.

The combination 6 with 8, incorporating the bleach activator, gave good performance.

The combination 6 with 7 gave poor performance because of the presence of the common hydrophobes, the caprylate and mineral oil.

Perfume Performance

Four blocks were formulated in accordance with the following table. Blocks A and B are standard prior art formulations incorporating a chlorine source bleaching agent (sodium dichloroisocyanurate) and a perfume (Yellow Zest and Lemonzone). Block C is a two part block in accordance with the invention having bleach containing and perfume containing parts of equal weight. Block D is a perfume (Limonia) non-bleach containing block.

The blocks were tested in a rim cage in a standard UK91 wash down toilet, operated at 17 flushes per day, with hard water (250 to 300 ppm measured as calcium carbonate).

Figure 2:
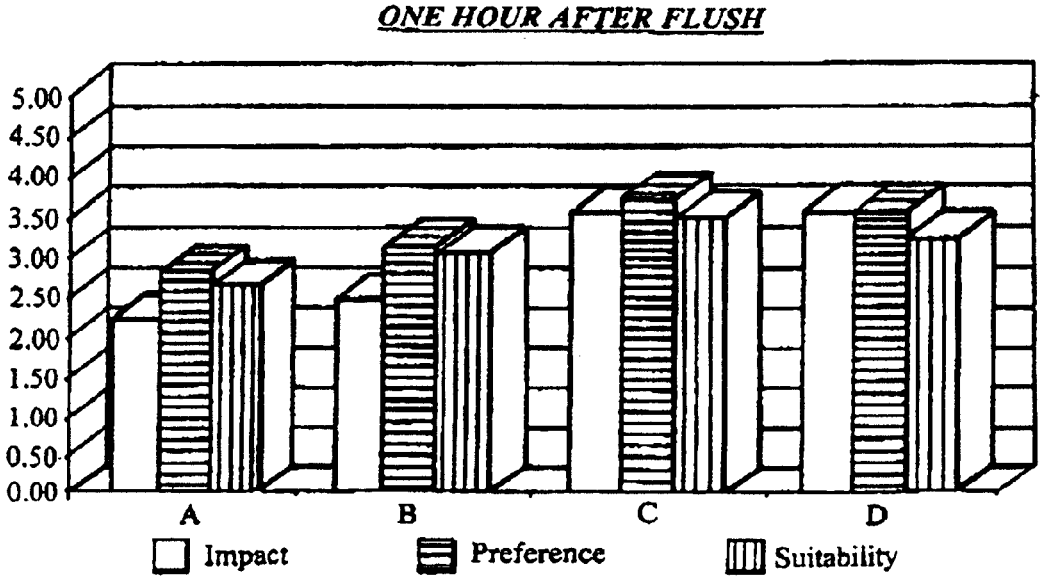

The performance of the block was tested by a panel of users by engaging the users impression on the 3rd day, after the 4th flush, and the results are presented in FIGS. 1 and 2.

Block A contains a perfume, Yellow Zest, which does not have good stability and this is out performed by block B, which has a bleach stable perfume Lemonzone. As might be expected from the discussion of the prior art cistern blocks, the two-p art block, block C, out performs both blocks A and B. Note, however, that block C has the non-bleach stable perfume Yellow Zest of block A, and also has a lower amount (3.5% by weight compared to 4.5%) of perfume which is delivered over a much longer lifetime (28 days compared to 15 days). Thus the degree of improvement is remarkable.

Even more remarkable is that block C, the two part block, one hour after the flush out performs the standard perfume containing non-bleach product, block D, which again has a much higher perfume content of 3.75 gm (7.5% of 50 gm) compared to 1.4 gm (3.5% of 40 gm) in block C.

| | % w/w | | | | |
|---|---|---|---|---|---|
| Raw Material/Block | A | B | C | | D |
| 1 | 25 | 25 | 0 | 40.3 | 0 |
| 2 | 0 | 0 | 50 | 0 | 0 |
| 3 | 0 | 0 | 0 | 19.5 | 0 |
| 4 | 15 | 15 | 0 | 0 | 0 |
| 5 | 0 | 0 | 0 | 0 | 76.0 |
| SDIC | 25 | 25 | 0 | 30.0 | 0 |
| Calcium Sulphate | 30.285 | 30.285 | 0 | 0 | 0 |
| Sodium Sulphate | 0 | 0 | 37.92 | 0 | 12.285 |
| $MgSO_4.3H_2O$ | 0 | 0 | 5.0 | 0 | 0 |
| Titanium dioxide | 0.2 | 0.2 | 0 | 0.2 | 0.2 |
| 6 | 0 | 0 | 0 | 7.0 | 0 |
| Mineral Oil | 0 | 0 | 0 | 3.0 | 0 |
| Yellow Zest VI | 4.5 | 0 | 7.0 | 0 | 0 |
| Lemonzone LS58473 | 0 | 4.5 | 0 | 0 | 0 |
| Paliogen Yellow L1560 | 0.015 | 0.015 | 0.08 | 0 | 0 |
| Bitrex | 0 | 0 | 0 | 0 | 0.01 |
| Fettgelb 3G | 0 | 0 | 0 | 0 | 0.005 |
| Limonia K0/239397 | 0 | 0 | 0 | 0 | 7.5 |
| 7 | 0 | 0 | 0 | 0 | 4.0 |
| Total Weight/G | 40 | 40 | 20 | 20 | 50 |
| Life of Block/Days | 15 | 28 | 28 | | 28 |

Key
1 - Alkylarylsulphonate 90% additive sodium sulphate
2 - Alkylarylsulphonate 80% additive sodium citrate
3 - Alkylarylsulphonate 80% additive $MgSO_4.3H_2O$
4 - Secondary alkane sulphonate (sodium salt)
5 - Alkylarylsulphonate 80% additive Toluene sulphate
SDIC - Sodium dichloroisocyanurate dihydrate
6 - Triethylene glycol caprylate caprate
Paliogen Yellow L1560 - Pigment
Fettgelb 3G - Pigment
7 - Cocomonoethanolamide

What is claimed is:

1. A lavatory cleansing block which has been formed by extruding two compositions, in which:

a first one of the compositions comprises a bleach, and a first hydrophobe component; and a second one of the compositions comprises a second hydrophobe component, and a perfume which is not stable in the presence of the bleach in the first composition;

wherein the first hydrophobe and the second hydrophobe are different from each other, and the first composition does not include any hydrophobe which is present in the second composition.

2. The block as recited in claim 1, wherein one of the compositions comprises a colorant.

3. The block as recited in claim 1, wherein the perfume is a hydrophobe.

4. The block as recited in claim 1, wherein a second perfume, which is stable in the presence of the bleach, is incorporated in the first composition.

5. The block as recited in claim 1, wherein the block is a rim block.

6. The block as recited in claim 1, wherein the block is a cistern block.

7. The block as recited in claim 1, wherein the second composition includes a bleach activator.

8. The block as recited in claim 7, wherein the bleach activator is sodium bromide.

9. The block as recited in claim 1, wherein both compositions include a surfactant.

10. The block as recited in claim 1, wherein the bleach comprises a halogen release agent.

11. The block as recited in claim 10, wherein the bleach comprises a chlorine release agent.

12. The block as recited in claim 11, wherein the bleach is an N-chlorinated cyanuric acid derivative.

13. The block as recited in claim 1, wherein the compositions are co-extruded.

14. The block as recited in claim 1, wherein the bleach is present in an amount of 2 to 75% by weight of the complete block.

15. The block as recited in claim 1, wherein the first and second ones of the compositions have about the same weight.

16. The block as recited in claim 1, wherein wherein the first and second ones of the compositions have about the same size.

17. The block as recited in claim 1, wherein the perfume is present in an amount of 0.5 to 15% by weight of the complete block.

* * * * *